United States Patent [19]

Charbonnier

[11] Patent Number: 4,592,195

[45] Date of Patent: Jun. 3, 1986

[54] DEVICE FOR MAKING CABLED YARNS OF IMPROVED REGULARITY

[76] Inventor: Simon Charbonnier, 97 rue Pasteur, Caluire, 69300, France

[21] Appl. No.: 741,087

[22] Filed: Jun. 4, 1985

[30] Foreign Application Priority Data

Jun. 5, 1984 [FR] France ..... 84 08975

[51] Int. Cl.[4] ..... D02G 3/28; D02G 3/00; D02G 3/48; D01H 7/00

[52] U.S. Cl. ..... 57/58.36; 57/58.3; 57/58.52; 57/58.86

[58] Field of Search ..... 57/58.3–58.38, 57/58.86, 58.52

[56] References Cited

U.S. PATENT DOCUMENTS

| | | | |
|---|---|---|---|
| 2,902,817 | 9/1959 | Schrenk et al. | 57/58.36 |
| 2,914,903 | 12/1959 | Klein et al. | 57/58.36 X |
| 2,949,725 | 8/1960 | Renzini | 57/58.36 |
| 2,961,824 | 11/1960 | Klein | 57/58.36 |

*Primary Examiner*—John Petrakes
*Attorney, Agent, or Firm*—Dowell & Dowell

[57] ABSTRACT

This invention relates to a device for making cabled yarns of considerable regularity wherein a first yarn is firstly braked by a progressive brake, then it is subjected to a false twist. A second yarn is braked in order to impose a very regular tension thereon. The two yarns pass through a rotating system comprising two pulleys coupled with each other which ensure that the advance of these two yarns is identical. The composite or cabled yarn then passes through a system for stopping the progression of the twist. Finally, the cabled yarn arrives at a distribution device, care being taken to provide a large distance d between the distribution device and the last point of guiding of the yarn which is located opposite the center of the stroke of the yarn distribution device. The invention is more particularly applicable to the manufacture for cabled yarns for pneumatic tires.

2 Claims, 1 Drawing Figure

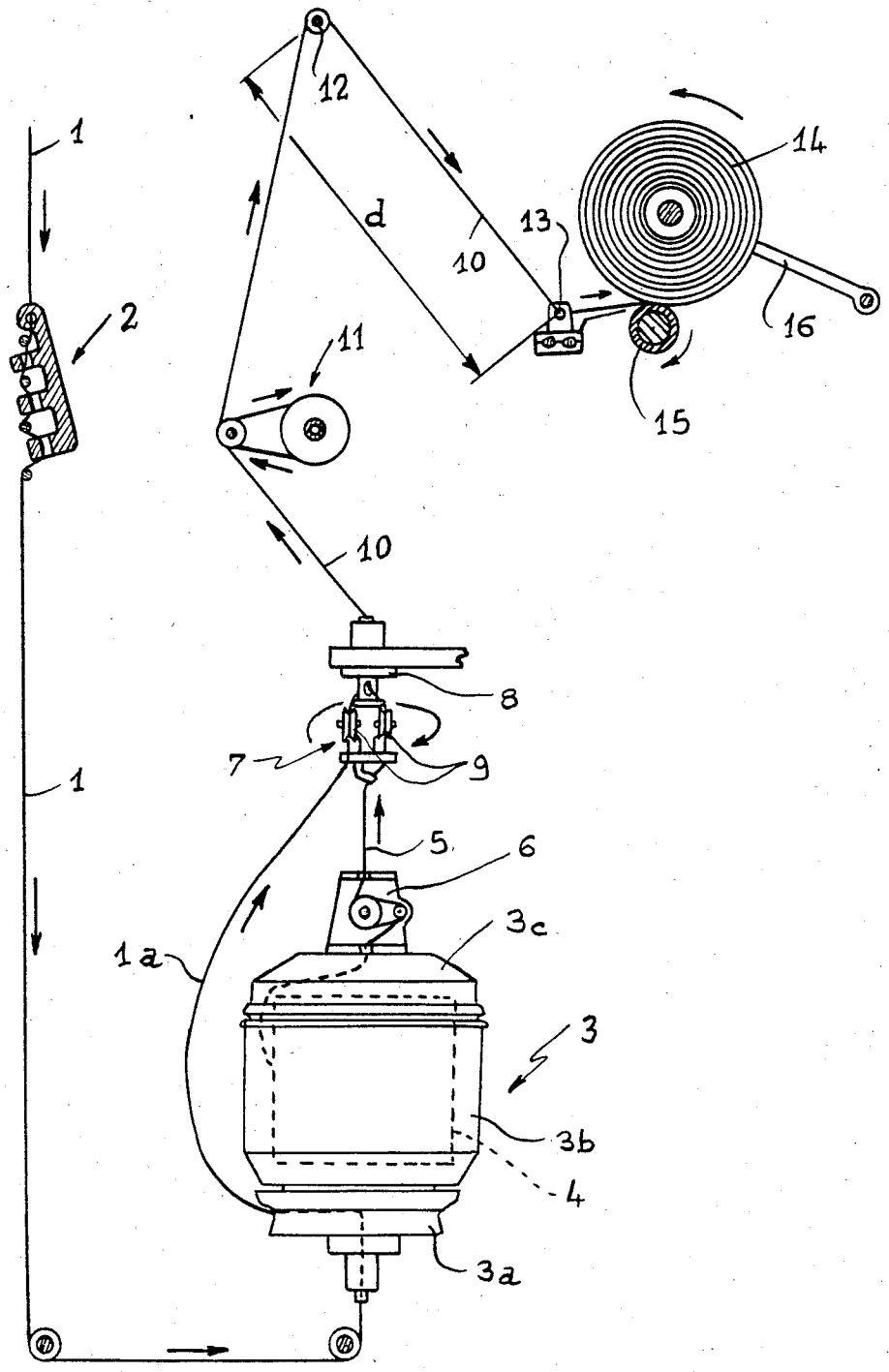
1
2
12
d
10
13
14
16
15
11
10
8
7
9
1
5
6
3c
1a
3
3b
4
3a

DEVICE FOR MAKING CABLED YARNS OF IMPROVED REGULARITY

The present invention relates to a device for making cabled yarns of considerable regularity.

It is known that, in certain applications, and more particularly in the pneumatic tire industry, the cabled yarns are required to present a very high tensile strength. Now, this requires not only the use of high quality textile materials, but the fibers constituting said materials and the elementary yarns which form the cabled assembly must be stressed very regularly by the forces coming into play. To satisfy this second condition, it is indispensible that the tensions and twists coming into play during stranding be, themselves, strictly regular over the whole length of the cord in question. Now, practice shows that this is not the case when conventional stranding devices, and in particular the so-called "direct stranding" devices, are used. As a result, if a small zone of a tire cover comprising such cabled yarns which are substantially parallel to one another is considered for example, the tensions are not distributed regularly either between themselves or between their fibers or other elements, with the result that certain of the yarns are already overloaded at least locally while others undergo only an average load much less than what they could withstand. This limits the average load in the zone in question and therefore necessitates the use of cabled yarns which are larger, more expensive and heavier.

Special layplates have already been proposed whereby the regularity of the product obtained is improved. However, the results obtained up to the present time are in no way decisive.

It is an object of the invention to improve the devices of the type in question.

According to the invention, the procedure is as follows:

1. A first yarn, substantially without considerable twist, is taken from a non-rotating reserve (fixed bobbin, creel) and is passed into a progressive braking device so as to render its component strands parallel and to ensure regular distribution of the tension therebetween.

2. A false twist is imparted to this first yarn by causing it radially to traverse the base plate of a rotating spindle bearing the storage bobbin of a second yarn.

3. The spindle comprises a device for braking this second yarn, said device being provided so as to ensure considerable regularity of the tension that it imposes on the corresponding yarn.

4. The two yarns are passed into a rotating system coaxial to the spindle and comprising two pulleys on which these yarns wind on passing so as to ensure identical advance thereof, this system being driven by the very reaction of the yarns.

5. The composite yarn thus obtained by winding the first and the second yarn around each other is passed through a system adapted to stop progression of the twist, such as for example an assembly of pulleys on which this yarn winds on passing.

6. Finally, the said composite yarn, or cabled yarn, is taken to a winding distribution device at constant linear speed with a mobile yarn guide distributing turns over the length of the bobbin, care being taken, however, to provide, possibly by means of a guide element, a large distance between the last point of guiding of the yarn and the distributor yarn guide which ensures winding.

It should be noted that all the elements employed by the invention are known per se, but that they had never been used in the manner set forth hereinabove.

The invention will be more readily understood on reading the following description with reference to the accompanying drawings, in which:

The single FIGURE schematically shows an installation for carrying out the invention.

Referring now to the drawings, reference 1 indicates a first yarn coming from a fixed reserve such as a non-rotating bobbin, a creel, etc . . . . The yarn 1 is substantially without twist or at least with reduced twist, i.e. it is made of parallel strands not tightened against one another.

It is made to pass through a first braking device 2 composed of multiple successive elements, so as to ensure that the strands are parallel and to regularly distribute therebetween the tension resulting from braking. The regular yarn which emerges from device 2 arrives at the lower end of a hollow spindle 3. It penetrates therein, but leaves it almost immediately through a channel pierced radially in the plate 3*a* of the spindle. Due to the rotation of the latter, the yarn undergoes a false twist and it forms a rotating balloon 1*a* which surrounds the bowl 3*b* of the spindle.

This bowl 3*b* contains a bobbin 4 which carries a second yarn 5. On leaving the bobbin 4, this yarn 5 passes through a second braking device 6 borne by the cover 3*c* of the bowl 3*b* and arranged so as to ensure an extremely regular braking force. More particularly, a magnetic yarn brake may be used to this effect, in which said yarn 5 is tensioned several times in order to ensure a more perfect regularity.

The two yarns 1 and 5 arrive at a rotating device 7 rotatably borne by an upper bearing 8 mounted in the axis of the spindle 3. This device comprises two pulleys 9 disposed along the same axis transverse to that of the spindle 3 and angularly coupled with each other. The yarns wind on said pulleys on passing, then together emerge through the bore of the axis of device 7. The presence of the pulleys 9 ensures that the advances or deliveries of the two yarns 1 and 5 are always equal.

The composite yarn 10 formed by the two elementary yarns 1 and 5 then arrives at a device 11 adapted to prevent the twist from rising further. This device 11 may be constituted by a system incorporating two pulleys or more around which the yarn winds through large angles on passing.

On leaving the device 11, the yarn 10 passes over a pulley or yarn guide 12 which directs it to the reciprocating yarn distributor 13 adapted to ensure regular winding of the bobbin 14 which constitutes the desired final product, this bobbin resting on a drive drum 15 and being maintained by one or two arms such as 16.

The fixed pulley or yarn guide 12 is, of course, disposed in the plane passing through the centre point of the stroke of the mobile yarn distributor 13, but, in addition, the distance d separating this pulley 12 from the said central point is provided to be as large as allowed by considerations of dimensions, so that the variations in length of that part of the yarn 10 included between said guide 12 and the mobile yarn distributor 13 and which result from the displacement of the latter on either side of said central point, are as small as possible and have virtually no influence on the tension of the yarn wound on the bobbin.

It will be understood that the arrangements described hereinabove make it possible finally to obtain a cord of extremely regular constitution in which any possible tension is distributed very regularly between the various strands and which consequently presents a tensile strength virtually equal to the combined tensile strength of said strands.

It must, moreover, be understood that the foregoing description has been given only by way of example and that it in no way limits the domain of the invention which would not be exceeded by replacing the details of execution described by any other equivalents.

What is claimed is:

1. A device for directly making a high-resistance cabled yarn having improved regularity, comprising:

A. yarn twisting means, comprising:

(a) a first progressive braking device having multiple successive elements operative to receive a first yarn having multiple component strands and to distribute tension regularly therebetween and render the strands substantially parallel;

(b) false twist spindle means including a rotating spindle having a radial channel for receiving the first yarn, said spindle means supporting the supply bobbin of a second yarn;

(c) a second braking device on the spindle means and operative to receive the second yarn and apply thereto a regular braking force;

(d) a first pulley system disposed axially of the spindle means and mounted to rotate thereabout, the first system including two pulleys coupled for rotation together and said pulleys receiving the respective yarns wound therearound and driving the coupled pulleys whereby to impart to the two yarns identical rates of advance, and the system rotating to twist the first and second yarns together to form a composite yarn;

(e) a second system of pulleys disposed to receive and wind the composite yarn therearound to stop progression of the twist along the passing yarn; and B. yarn winding means, comprising:

(a) a constant linear speed winding device and receiving bobbin; and (b) a yarn distributor means located adjacent to the winding device and receiving bobbin and reciprocating with a transverse stroke across the receiving bobbin, said yarn twisting means delivering the composite yarn in a transverse plane passing through the center of the stroke of the distributor means, and the composite yarn distributor means being spaced by a large distance d from the yarn twisting means whereby to minimize variations in the distance d as the distributor means progresses on either side of the center of the stroke so that tensions in the composite yarn are distributed very regularly between its various strands to provide a composite tensile strength substantially equal to the combined tensile strengths of the strands.

2. A device as claimed in claim 1, further including a composite yarn guide interposed between the yarn twisting means and the yarn winding means in said plane and operative to receive the composite yarn from the second system of pulleys and guide it toward said distributor means, the distance d comprising the distance in said plane between the composite yarn guide and the distributor means at the center of its stroke.

* * * * *